US005127768A

United States Patent [19]

Crawshaw et al.

[11] Patent Number: 5,127,768

[45] Date of Patent: Jul. 7, 1992

[54] RECIRCULATING SOIL GAS REDUCTION SYSTEM

[76] Inventors: Donald A. Crawshaw, 42 Lehigh Rd., Wellesley, Mass. 02181; Geoffrey K. Crawshaw, 42 Silver Hill, Apt. #4,, Natick, Mass. 01760

[21] Appl. No.: 646,854

[22] Filed: Jan. 28, 1991

Related U.S. Application Data

[63] Continuation-in-part of Ser. No. 414,907, Sep. 29, 1989, Pat. No. 4,980,237.

[51] Int. Cl.[5] ..... E02D 19/00

[52] U.S. Cl. ..... 405/229; 52/302; 405/128; 454/909

[58] Field of Search ..... 405/128, 129, 229, 303, 405/52; 52/169.1, 169.5; 98/33.1

[56] References Cited

U.S. PATENT DOCUMENTS

| | | | |
|---|---|---|---|
| 2,746,372 | 5/1956 | Smith et al. | 98/33.1 X |
| 2,751,838 | 6/1956 | Jones | 98/33.1 |
| 4,175,934 | 11/1979 | Lang et al. | 98/33.1 X |
| 4,523,630 | 6/1985 | Wiklund | 98/33.1 X |
| 4,557,247 | 12/1985 | Hara et al. | 98/33.1 X |
| 4,578,912 | 4/1986 | Ericsson . | |
| 4,620,398 | 11/1986 | Wallin . | |
| 4,651,380 | 3/1987 | Ogden . | |
| 4,773,309 | 9/1988 | Walters . | |
| 4,789,388 | 12/1988 | Nishibata . | |
| 4,798,034 | 1/1989 | Jarnagin . | |
| 4,801,800 | 1/1989 | Scheible . | |
| 4,829,882 | 5/1989 | Jackson . | |

OTHER PUBLICATIONS

EPA/625/5-86-019, "Radon Reduction Techniques for Detached Houses," 32-41 (1986).

*Primary Examiner*—Dennis L. Taylor

[57] ABSTRACT

A system and method is disclosed for venting soil gas to the atmosphere. Activation of a gas flow means, such as a fan disposed within a housing, directs soil gas from a gas source through a coduit, a housing and a vent to thereby vent the gas to the atmosphere. A shell is disposed about the housing and the vent, thereby defining an annular shell conduit about the housing and vent. A shell outlet at the housing inlet provides fluid communication between the shell conduit and the housing inlet. The gas flow means causes the shell conduit to be under reduced pressure relative to atmospheric pressure. Significant discharge of soil gas from the ventilation system through ruptures or defects in the housing, the vent or the shell is prevented by reduced pressure in the shell conduit, which causes a draft of air or soil gas to be drawn through the apertures into the shell conduit for subsequent ventilation of a substantial portion of the air or soil gas to the atmosphere.

10 Claims, 4 Drawing Sheets

RECIRCULATING SOIL GAS REDUCTION SYSTEM

RELATED APPLICATION

The following is a continuation-in-part application of U.S. Pat. application No. 07/414,907, filed Sep. 29, 1989, issuing as U.S. Pat. No. 4,988,237 on Jan. 29, 1991, and assigned to the assignee of the present invention. That patent is herein incorporated by reference.

BACKGROUND OF THE INVENTION

Gases emanating from soil adjacent building foundations often include components which can be harmful to occupants of structures disposed on the building foundations. Cracks and pores in building foundations can allow gases emanating from the soil to penetrate building foundations and consequently contaminate living space. An example of a harmful gas is radon, which is a decay product of Uranium-238 occurring naturally in soil. Lung cancer has been associated with the presence of radon gas in homes. Examples of other gases, which can emanate from soil, are volatile organic chemicals, such as 1,1, dichloroethylene, trichloroethylene, parachloroethylene and other volatile chemicals, including pesticides, etc.

One method tried to remove radon from building foundations is by filtration to remove radon from the air. However, filters have not proven to be effective for removal of radon because radon is a gas and the predominate portion of radon remains unattached to particulates collected by filters.

Another attempt to control the presence of radon within building structures has been application of sealing materials to points of entry of radon in foundation structures, such as at: wall and floor joints; settling cracks; utility ports, such as cable connections; and pores within the concrete of building foundations. However, sealants typically deteriorate over prolonged periods of time. Further, cracks tend to propagate, thereby substantially reducing the effectiveness of seals.

In still another attempt to remove radon gas from building foundations, radon-containing gas is drawn from beneath building foundations or from points of entry, such as at seams in building foundations, and is discharged to the atmosphere. Typically, the gas is discharged to the atmosphere by operation of fans disposed in vents. However, such fans have been generally restricted to locations outside of building foundations and building structures in order to prevent discharge of ventilated gas into building structures from leaks in fan housings or through leaks at vents disposed within building structures. Disposition of fans outside of building foundations and building structures has often been problematic because of exposure of fans to potentially damaging environmental conditions, such as rain, snow and ice. Also, extreme temperature conditions can impair the operation of fans and limit their useful life.

Thus, a need exists for a system and method for venting a gas from a building foundation which overcome or minimize the forementioned problems.

SUMMARY OF THE INVENTION

The present invention relates to a new system and a new method for venting gas from a building to the atmosphere.

The system includes a housing forming a housing chamber about a gas flow means, said housing having an inlet and an outlet. A vent is coupled to the outlet for venting the chamber to the atmosphere. A shell is disposed about the housing and vent with a space therebetween forming a shell conduit, and an opening in said shell adjacent to the inlet. A conduit couples gas to be vented to the opening.

A method for venting a gas from a gas source at a building to the atmosphere includes directing the gas from the gas source through a conduit extending within the gas source and through a housing inlet of a housing by activation of a gas flow means, such as a fan, disposed within the housing. The gas in the housing chamber is vented by the fan through a housing outlet of the housing and through a vent, which extends from the housing outlet, to a vent outlet end of the vent at the atmosphere. The pressure of the gas is reduced below atmospheric within a shell conduit, defined by the housing and the vent and a shell disposed about the housing and the vent, in an amount sufficient to cause gas entering the shell conduit to be directed from the shell conduit through a shell conduit outlet, the shell conduit outlet providing fluid communication between the shell conduit and the housing inlet, and through the housing and the vent for discharge to the atmosphere.

This invention has many advantages. Gases penetrating a building foundation or a building structure from soil can be ventilated to the atmosphere by a system having a gas flow means, such as a fan, which is disposed within the building. Leakage of gas through the housing or the vent back into the building is prevented by the shell conduit, which directs the leaking gas back to the fan. Further, damage to the shell will not cause discharge of significant amounts of gas into the building because reduced pressure within the shell conduit caused by the fan will direct air through the defect into the shell conduit for discharge to the atmosphere by the fan. Likewise, rupture of the vent and the shell will not result in discharge of gas into the building foundation because a draft from the vent into the shell conduit and from the building foundation into the shell conduit will be caused by the fan. Therefore, the fan can be disposed within a building foundation or a building structure without presenting a significant risk of discharging the gas back into the building. Further, disposing the fan within the building eliminates the need for shielding the fan from adverse weather conditions by a separate means designated for that purpose.

DETAILED DESCRIPTION OF THE INVENTION

The features and other details of the system and method of the invention will now be more particularly described with reference to the accompanying drawings and pointed out in the claims. The same number present in different figures represents the same item. It will be understood that the particular embodiments of the invention are shown by way of illustration and not as limitations of the invention. The principle features of this invention can be employed in various embodiments without departing from the scope of the invention.

Figure 1:
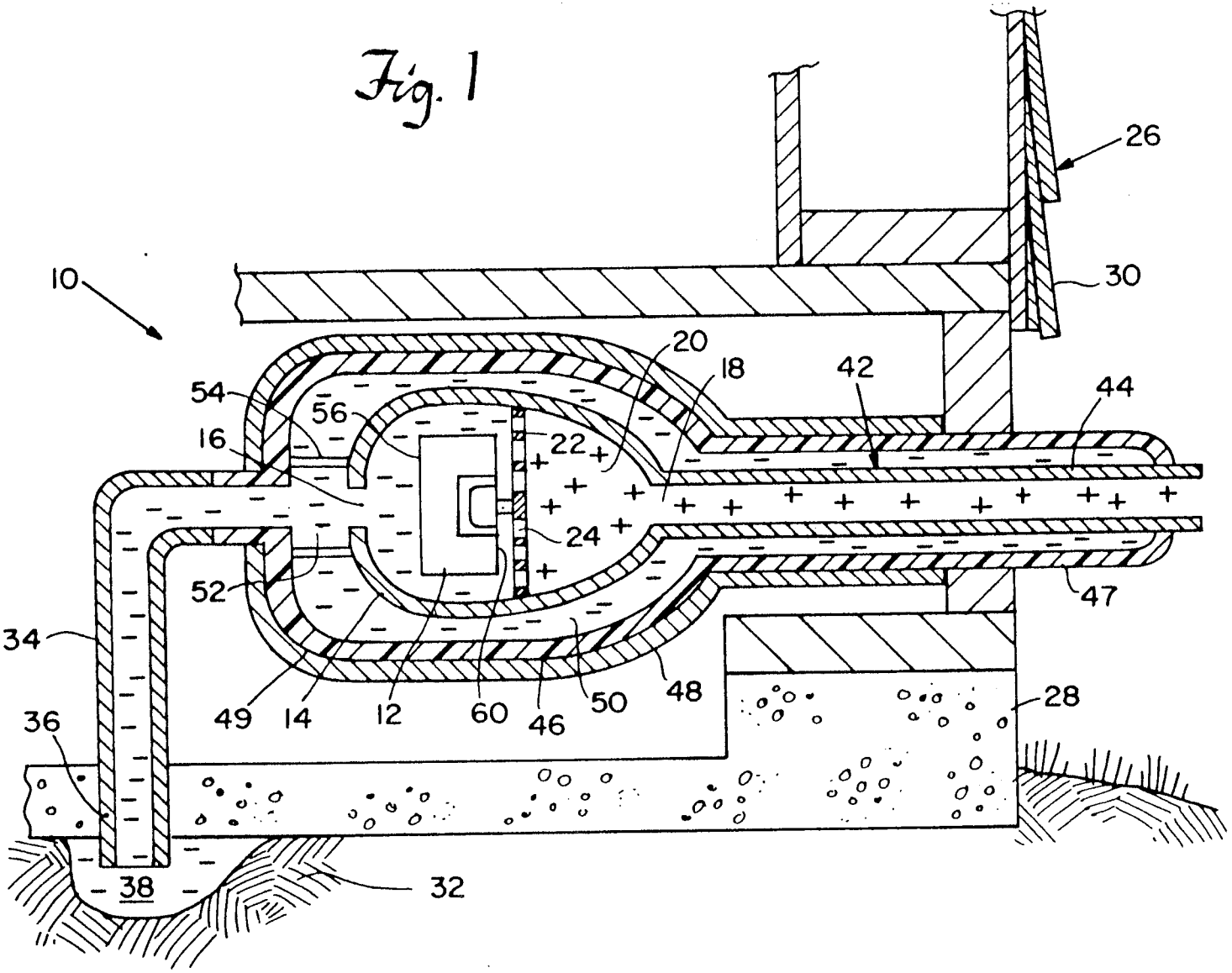
FIG. 1 is a section view of one embodiment of the invention as installed in a building.

In one illustration of the invention, shown in FIG. 1, a ventilation system 10 includes fan 12 disposed in housing 14. Housing 14 includes a housing inlet 16 and a housing outlet 18. Housing 14 defines housing chamber 20. Fan 12 is supported within housing 14 adjacent to housing inlet 16 by a perforate partition 22 which is fixed to housing 14. Perforate partition 22 is provided with apertures 24 for permitting fluid communication between housing inlet 16 and housing outlet 18.

Fan 12 is a suitable gas flow means for directing or pulling gas within a foundation through a vent to the atmosphere. Examples of suitable fans include centrifugal-type fans, regenerative-type fans, multistage-type fans, etc. In a preferred embodiment, fan 12 is a centrifugal-type fan.

It is to be understood that, alternatively, a low-flow, high-vacuum pump can be employed as a gas flow means rather than fan 12, such as is described in U.S. Pat. No. 4,988,237, the teachings of which are incorporated herein by reference. An example of a suitable low-flow, high-vacuum pump is a commercially available regenerative blower. "Low-flow," as that term is used herein, means a volumetric flow of gas less than about 125 standard cubic feet per minute. "High-vacuum," as that term is used herein, means an absolute pressure greater than about two inches of water at about 68° C.

Building 26 includes building foundation 28 and building structure 30. Building structure 30 is disposed on building foundation 28. Building foundation 28 is disposed within soil 32. Housing 14 is disposed within building 26.

Conduit 34 has a conduit inlet end 36 and extends within building foundation 28. Conduit inlet end 36 is disposed in subterranean cavity 38, which is defined by building foundation 28 and soil 32. Conduit 34 is at less than atmospheric pressure when fan 12 is operated. Conduit 36 provides fluid communication between subterranean cavity 38 and housing inlet 16. Gas emanating from soil 32 into subterranean cavity 38 forms a gas source.

It is to be understood that when soil 32 is substantially comprised of relatively fine-grained particles, such as sand, a preferred gas flow means is a low-flow, high-vacuum pump. Alternatively, when soil 32 is substantially comprised of relatively coarse-grained particles, such as stones, a preferred gas flow means is fan 12. Also, it is to be understood that, alternatively, conduit inlet end 36 can be disposed within building foundation 28 or building structure 30 to remove gases therefrom. When conduit inlet 36 is disposed in building foundation 28 or building structure 30, a preferred gas flow means is fan 12.

Vent 42 is coupled to housing 14 and extends from housing outlet 18 through building structure 30 to the atmosphere. Vent 42 has a vent outlet end 44 disposed at the atmosphere outside of building 26. A toroidally-shaped shell 46, having a neck portion 47, a toroidal portion 49, and formed of an impervious material, such as plastic, is disposed in spaced relationship about housing 14 and about vent 42. If required, lead insulation 48 covers all external portions of shell 46 inside building 26 to shield building 26 from gamma rays emanating from radon gas in housing 14. The space between vent 42 and shell 46 and between housing 14 and shell 46 defines a shell conduit 50. The shell conduit 50 meets with housing inlet 16 at port 52 on the toroidal end 49 of shell 46. Port 52 provides fluid communication between shell conduit 50 and housing inlet 16. Pins 54 extend between shell 46 and housing 14 at shell conduit outlet 52 for supporting one end of housing 14 within shell 46. The other end of housing 14 is coupled to vent 42 which is supported by the neck portion 47 of shell 46.

Activation of fan 12 causes pressure of gas within conduit 34, shell conduit 50 and within housing 14 at intake side 56 of fan 12 to be less than atmospheric, as indicated by the minus signs in FIG. 1. Also, the pressure of gas within housing 14 on exhaust side 60 of fan 12 and within vent 42 is greater than atmospheric, as indicated by the plus signs.

Gas emanating from the gas source at subterranean cavity 38 is directed by fan 12 into conduit 34 through conduit inlet end 36. The gas flows through conduit 34 and through housing inlet 16 into housing 14. The gas passes through fan 12, apertures 24 of perforate partition 22 and through housing outlet 18 into vent 42. The amount of gas withdrawn from subterranean cavity 38 through conduit 34 is sufficient to significantly reduce the concentration of gas penetrating building foundation 28 and building structure 30 from soil 32. The gas emanating from the gas source, such as from soil 32, can include gases which are harmful to human inhabitants of building 26 if the gas is not ventilated to the atmosphere.

Conduit 34 and shell conduit 50 are under partial vacuum during activation of fan 12. Therefore, significant release of gas from ventilation system 10 will be prevented by a draft directing the gas into shell conduit 50 at any potential point of release of gas from ventilation system 10 within building 26.

Figure 2:
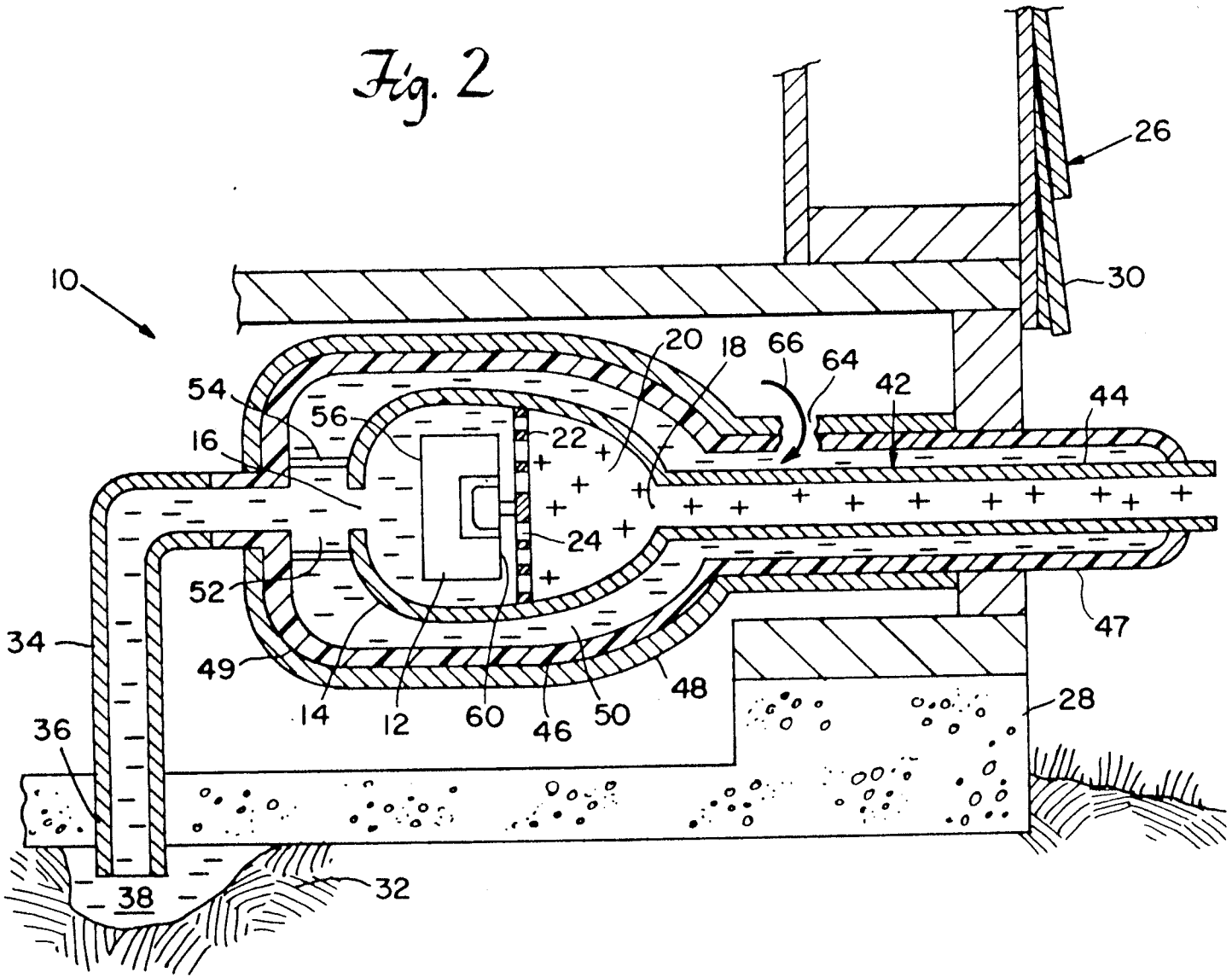
FIG. 2 is a section view of the embodiment shown in FIG. 1, illustrating what happens if a shell is ruptured.

For example, as illustrated in FIG. 2, rupture of shell 46 will cause air at shell 46 to be drawn through aperture 64, formed by the rupture, into shell conduit port 52, as is indicated by arrow 66. The air is thereby directed through shell conduit 50 and housing inlet 16 for ventilation by fan 12 through vent 42 to the atmosphere. Significant release of gas from within shell conduit 50 into building foundation 26 is prevented by the current of air caused by partial vacuum within shell conduit 50. Likewise, rupture of conduit 34 causes a current of air which directs air from building 26 into conduit 34 because of partial vacuum within conduit 26.

Figure 3:
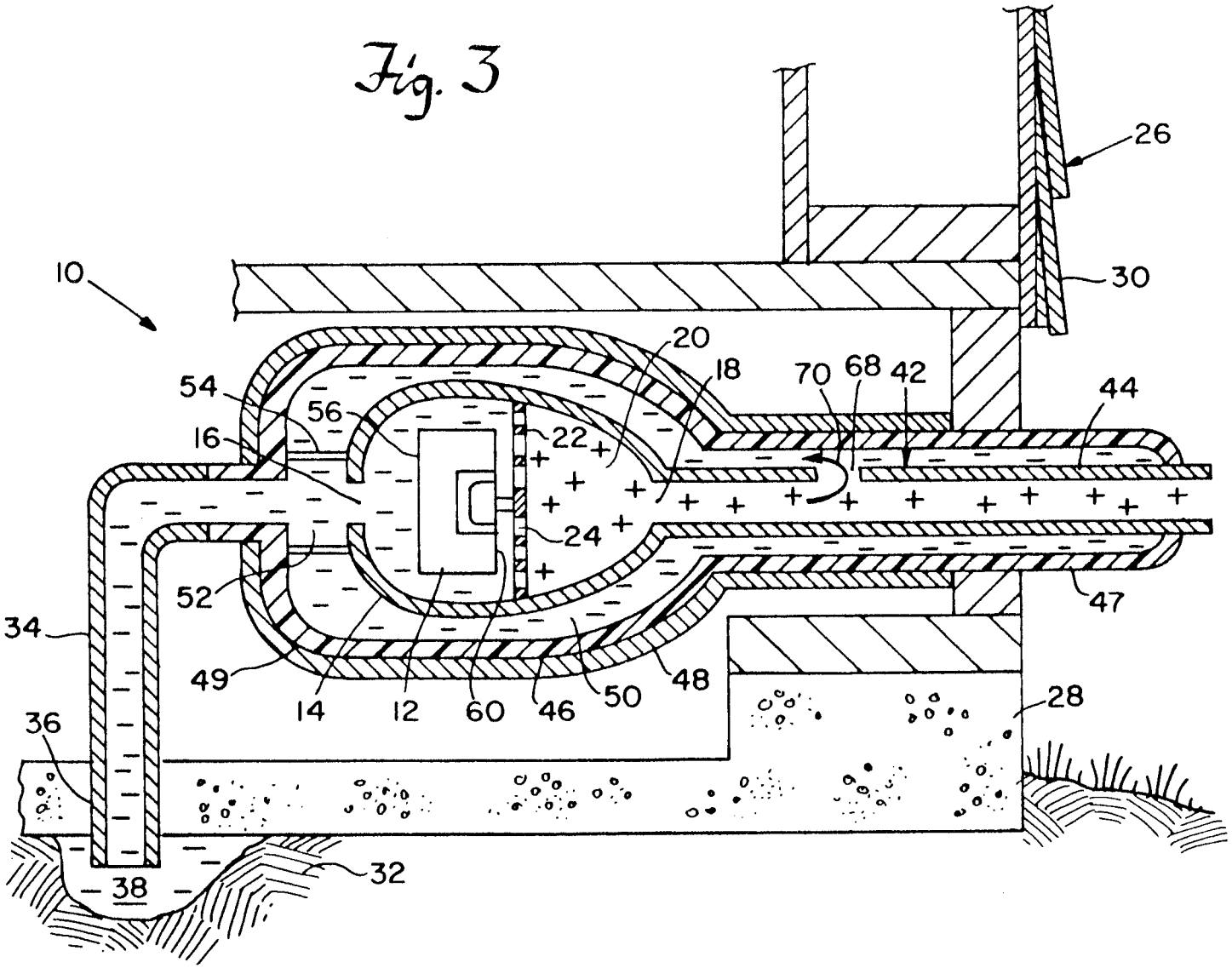
FIG. 3 is a section view of the embodiment shown in FIG. 1, for illustrating what happens when a vent is ruptured.

In another illustration of the invention, shown in FIG. 3, rupture of vent 42 and consequent leakage of gas from vent 42 through aperture 68 causes the gas to be directed from vent 42 into shell conduit 50 in a direction indicated by arrow 70. The gas is then directed through shell conduit 50 and through housing inlet 16 for redelivery to fan 12, whereby the gas is redirected through vent 42. A substantial portion of the gas leaking from vent 42 through aperture 68 is thereby discharged to the atmosphere and significant leakage of gas from vent 42 into building 26 is prevented.

Figure 4:
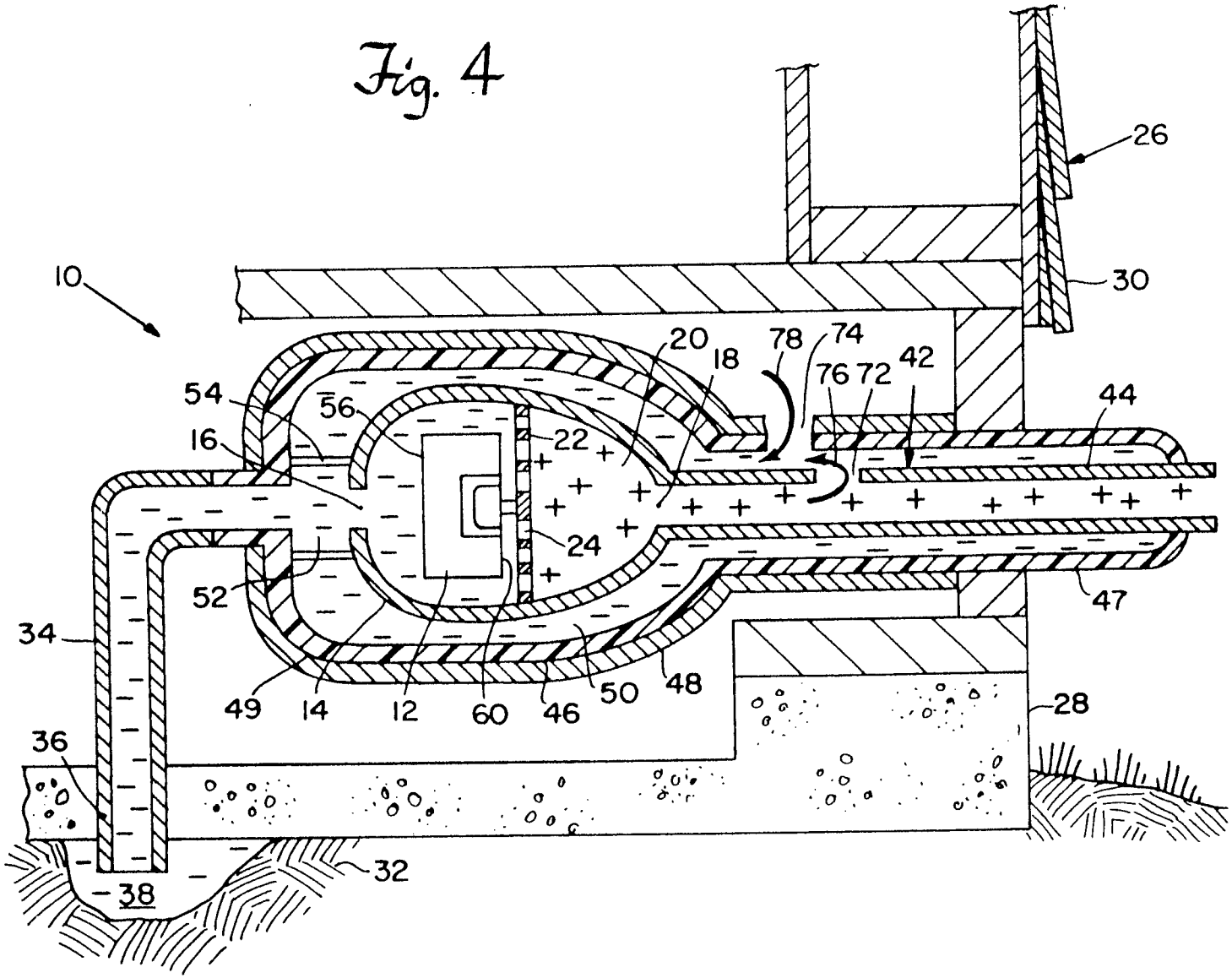
FIG. 4 is a section view of the embodiment shown in FIG. 1, wherein both the vent and the shell are ruptured.

In still another illustration of the invention, shown in FIG. 4, significant discharge of gas from vent 42 into building 26 is prevented despite rupture of vent 42 and of shell 46 which forms apertures 72 and 74, respectively. Gas leaking through aperture 72 caused by rupture of vent 42 is directed from vent 44 into shell conduit 50, as is indicated by arrow 76. Simultaneously, air in building 26 is directed into shell conduit 50 through the aperture 74, formed by rupture of shell 46, as is indicated by arrow 78. Significant discharge of gas leaking through aperture 74 in vent 42 is thereby prevented from being discharged into building 26 through aperture 74 in shell 46.

The concentration of gas within building 26 is substantially reduced by ventilating the gas emanating from soil 32 through ventilation system 10 to the atmosphere. Ventilation system 10, including fan 12 and housing 14, can be disposed within building 26 without a significant risk of discharging gas from ventilation system 10 into building 26 by rupture of housing 14, conduit 34, vent 42 or shell 46.

Equivalents

Those skilled in the art will recognize, or will be able to ascertain using no more than routine experimentation, many equivalents to specific embodiments of the invention described specifically herein. Such equivalents are intended to be encompassed in the scope of the following claims.

We claim:

1. A system for venting gas from a gas source to the atmosphere, comprising:

a) a housing forming a housing chamber and having a housing inlet and a housing outlet;

b) a gas flow means disposed in the housing chamber for directing the gas to the atmosphere;

c) a vent extending from the housing outlet for providing fluid communication between the housing outlet and the atmosphere, the vent having a vent inlet end coupled to the housing outlet and a vent outlet end communicating with the atmosphere; and d) a shell disposed about the vent and housing with a space provided between the shell and the vent and the shell and the housing, with a port formed in the shell in fluid communication with the space; and e) a conduit for providing fluid communication between the gas source and the port.

2. A system of claim 1 wherein the gas flow means includes a vacuum pump.

3. A system of claim 1 wherein the gas flow means includes a fan.

4. A system of claim 1 wherein the gas includes a volatile organic gas.

5. A system of claim 1 wherein the gas includes radon gas.

6. A system of claim 1 further including lead insulation for shielding gamma rays emanating from the radon-containing gas extracted from the soil.

7. The system of claim 1 wherein the gas source is located beneath a building and the conduit extends within the building between the source and the port.

8. The system of claim 1 wherein the port is located in proximity to the housing inlet.

9. A method for venting a gas from a gas source to the atmosphere, comprising the steps of:

a) placing the gas source in fluid communication with a port formed in a shell surrounding a housing and a vent with a space provided between the housing and shell and vent and shell, said housing forming an inner chamber in which a gas flow means is disposed, said housing having an inlet and outlet;

b) venting the gas through the housing outlet and through the vent which extends from the housing outlet, and is in fluid communication with the atmosphere; and c) reducing the pressure below atmospheric in the space between the shell and housing and shell and vent by an amount sufficient to cause gas entering the space to be directed into the housing inlet and through the inner chamber of the housing and the vent for discharge to the atmosphere.

10. The method of claim 9 wherein the port is located in proximity to the housing inlet.

* * * * *